United States Patent [19]

Thompson

[11] Patent Number: 4,948,405

[45] Date of Patent: Aug. 14, 1990

[54] NITROGEN REJECTION UNIT

[75] Inventor: Max W. Thompson, Lake Jackson, Tex.

[73] Assignee: Phillips Petroleum Company, Bartlesville, Okla.

[21] Appl. No.: 456,393

[22] Filed: Dec. 26, 1989

[51] Int. Cl.[5] ..... F25J 3/02

[52] U.S. Cl. ..... 62/24; 62/28; 62/43

[58] Field of Search ..... 62/23, 24, 27, 28, 29, 62/41, 42, 43

[56] References Cited

U.S. PATENT DOCUMENTS

| | | | |
|---|---|---|---|
| 4,203,741 | 5/1980 | Bellinger et al. | 62/24 |
| 4,331,461 | 5/1982 | Karbosky et al. | 62/28 |
| 4,352,685 | 10/1982 | Swallow | 62/28 |
| 4,451,275 | 5/1984 | Vines et al. | 62/28 |
| 4,453,956 | 6/1984 | Fabbri et al. | 62/43 |
| 4,664,686 | 5/1987 | Pahade et al. | 62/24 |
| 4,701,200 | 10/1987 | Fisher et al. | 62/42 |
| 4,746,342 | 5/1988 | DeLong et al. | 62/42 |

OTHER PUBLICATIONS

Looney, S. K. et al., Technology, Oil and Gas Journal, 12-17-84, pp. 103-108.

*Primary Examiner*—Ronald C. Capossela
*Attorney, Agent, or Firm*—George E. Bogatie

[57] ABSTRACT

An improved process and apparatus is disclosed for rejecting nitrogen from a gaseous nitrogen-methane mixture while the nitrogen content of the mixture varies widely. The process, which is especially suited for recovery of nitrogen in an enhanced oil reservoir flooding project which employs nitrogen for flooding the reservoir; utilizes a modified dual distillation column arrangement including a relatively high pressure fractionator which lacks a conventional reboiler and a low pressure fractionator which lacks a conventional overhead condenser for liquid reflux.

13 Claims, 1 Drawing Sheet

NITROGEN REJECTION UNIT

This invention relates to separating nitrogen and hydrocarbons in a normally gaseous mixture containing nitrogen in variable amounts. In one aspect it relates to an apparatus and a process employing a modified dual distillation column arrangement for rejecting nitrogen from a gaseous stream. In another aspect it relates to an improved method for recovering nitrogen from a hydrocarbon stream containing $C_2$ and heavier hydrocarbon components.

BACKGROUND OF THE INVENTION

Interest in separation and recovery of nitrogen from a hydrocarbon gas stream, which contains variable amounts of nitrogen, comes primarily from recovery of nitrogen from gas streams associated with enhanced oil recovery (EOR) projects employing nitrogen for miscible flood of oil reservoirs. In these miscible flooding projects a nitrogen rejection unit (NRU) for producing a nitrogen product pure enough to allow the recovered nitrogen to be reinjected into the oil reservoir is required. In addition the NRU must have capacity for handling the gaseous feed mixture with a minimum of equipment changes while the nitrogen content of the recovered gas changes widely during the comparatively long life of the enhanced recovery project, and also while providing a fuel gas product stream of acceptable heating value, for example 875 btu/scf.

In response to the nitrogen recovery problem associated with enhanced oil recovery projects, several methods of separating nitrogen from methane have been developed. A commonly used method employs an integrated dual distillation column arrangement in which a high pressure column provides a rough nitrogen/methane split and a low pressure column makes the specification product. Generally these prior art methods have been designed for gaseous mixtures having a relatively low concentration of heavy hydro-carbons and/or a relatively unchanging nitrogen concentration in the gaseous mixture being processed, and therefore require equipment changes during the duration of the enhanced oil recovery project to accommodate the changing levels of nitrogen present in the gas to be processed.

Accordingly, it is an object of this invention to provide an improved integrated dual distillation system for removing nitrogen from a gaseous mixture containing nitrogen and hydrocarbon components.

It is another object of this invention to provide an improved process for removing nitrogen from natural gas wherein the nitrogen concentration in the natural gas may vary from the naturally occurring concentration to as high as 75% or more.

It is yet another object of this invention to provide an improved process for treating a miscible flood gas wherein the miscible flood gas contains nitrogen along with a relatively high concentration of heavy hydrocarbons.

BRIEF SUMMARY OF THE INVENTION

In accordance with the present invention there is provided a method and an apparatus for improving process flow in an integrated dual distillation operation, which separates nitrogen and methane, in a system employing a high pressure (HP) fractionator and a low pressure (LP) fractionator, the method comprises the steps of:

(a) sufficiently cooling at least a portion a feedstream, essentially free of heavy hydrocarbons, comprising a gaseous nitrogen-methane mixture at a pressure of at least 400 psia so as to provide an at least partially condensed feedstream;

(b) separating said at least partially condensed feed stream in a first phase separator and withdrawing from said first phase separator a first stream comprising gaseous nitrogen-methane and a second stream comprising liquid nitrogen-methane, wherein said first stream is enriched in nitrogen and said second stream is enriched in methane;

(c) sufficiently cooling said first stream so as to provide an at least partially condensed first stream and introducing said at least partially condensed first stream into a middle portion of said HP fractionator;

(d) sufficiently expanding said second stream so as to provide an at least partially vaporized second stream and introducing said at least partially vaporized second stream into a lower portion of said HP fractionator, wherein said at least partially condensed first stream and said at least partially vaporized second stream are simultaneously fractionated in said HP fractionator at conditions sufficient to produce a third stream predosinately comprising gaseous nitrogen and a fourth stream predominately comprising liquid methane;

(e) sufficiently cooling said third stream so as to provide a partially condensed third stream;

(f) separating said partially condensed third stream in a second phase separator and withdrawing from said second phase separator a fifth stream predominately comprising liquid nitrogen and a sixth stream predominately comprising gaseous nitrogen;

(g) introducing said fifth stream into said HP fractionator as a liquid reflux;

(h) sufficiently cooling said sixth stream so as to provide an at least partially condensed sixth stream;

(i) separating said at least partially condensed sixth stream in a third phase separator and withdrawing a seventh stream predominately comprising liquid nitrogen and an eighth stream predominately comprising gaseous nitrogen from said third phase separator;

(j) introducing said seventh stream into a middle portion of said LP fractionator;

(k) expanding at least a portion of said eighth stream in an expander prior to introducing said eighth stream into an upper portion of said LP fractionator;

(l) recovering an overhead stream from said LP fractionator as a nitrogen product stream;

(m) withdrawing a bottom stream from said LP fractionator; and (n) combining said bottom stream with said fourth stream to form a hydrocarbon product gas stream.

Further aspects and additional advantages of the invention will be apparent from the following detailed description of the preferred embodiment of the invention as illustrated by the drawings in which:

DETAILED DESCRIPTION OF THE PREFERRED EMBODIMENT

Figure 1:
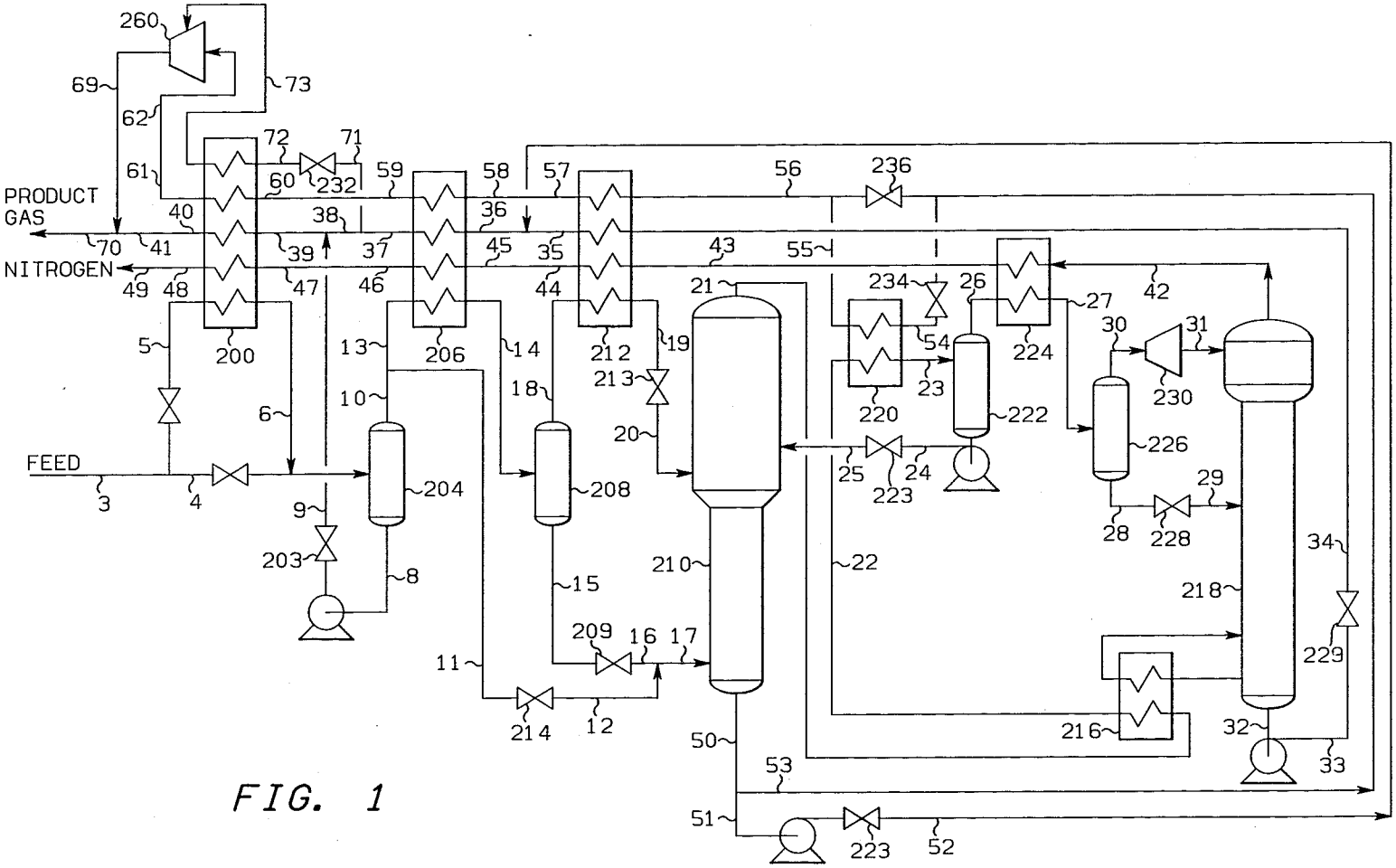
FIG. 1 is a schematic diagram illustrating process flow for nitrogen rejection according to this invention in a system employing dual distillation columns.

In treating a miscible flood gas, I have discovered an improved process for separating gaseous nitrogen and methane. As used herein a miscible flood gas is a mixture containing nitrogen, methane, ethane, some heavier hydrocarbon components and possibly some $CO_2$, wherein the nitrogen content can vary widely during the comparatively long life of the enhanced recovery program.

In a preferred embodiment of the invention, $CO_2$ and heavy hydrocarbons are first removed from a miscible flood gas stream and the flood gas, now essentially free of heavy hydrocarbons, is passed to a dual distillation system employing a high pressure fractionator which utilizes an overhead liquid reflux but does not utilize a reboiler, and a low pressure fractionator which utilizes a reboiler but does not utilize an overhead liquid reflux. A high purity nitrogen stream and a high btu content hydrocarbon gas stream are produced in accordance with the present invention.

It will be appreciated by those skilled in the art that, since FIG. 1 is schematic only, many items of equipment which would be needed for successful operation of a commercial plant have been omitted for the sake of clarity. Such items of equipment would include, for example, temperature, flow and pressure measurement instruments and corresponding process controllers, pumps, compressors, additional heat exchangers, valves, etc. All these items would be provided in accordance with standard chemical engineering practice to maintain desired conditions throughout the process and are not necessary to describe the present invention.

The present invention is applicable to recovering nitrogen from a gaseous mixture in which the nitrogen content varies widely and wherein the gaseous mixture contains a significant concentration of $C_2$ and higher molecular weight hydrocarbon components. It is particularly applicable to treating miscible flood gas produced from enhanced oil recovery. This flood gas recovery results in processing a gas having considerable nitrogen dilution, with a nitrogen concentration often in excess of 70 mole %, and also having a significant concentration of $C_2$ and higher molecular weight hydrocarbons.

It should also be understood that the representative temperatures and pressures set forth herein, with relation to the description of the drawing and the examples, are illustrative only and are not to be considered as limiting. The particular temperatures and pressures utilized in a particular separation will be dependent upon the nature and composition of the feed stream, upon the particular heat exchange surface areas available and upon the initial temperatures and pressures of the feed stream.

Referring now to FIG. 1, a feed gas stream containing methane and nitrogen, and having a significant concentration of $C_2$ and heavier hydrocarbons, at a pressure of at least 450 psia and preferably at about 800 psia or more is fed to the nitrogen rejection system through conduit 3. The feed gas stream could have for its origin, for example, a gas stream produced in a miscible flooding for enhanced oil recovery, in which case it would contain a high and variable nitrogen loading, which could increase to 70 mole % or more during the life of the EOR project, along with a significant concentration of $C_2$ and heavier hydrocarbons. If necessary other easily condensible contaminants such as $CO_2$ or $H_2S$ which may be found in a gas produced in a miscible flooding would be removed by, for example, absorption prior to entering the nitrogen rejection process via stream 3. Generally the nitrogen concentration of the feed gas stream 3 varies from about 40% to about 70% over the life of the EOR project.

The feed gas flowing in conduit 3 is divided so that a portion of the feed gas flows in conduit 5, and this portion is cooled by heat exchange with cooled exiting gas streams in chiller 200. Chiller 200 is bypassed by conduit 4, and the relatively warm feed gas flowing in conduit 4 is combined with the cooled gas in conduit 6 to form a combined stream in conduit 7 which is blended to a temperature of about −60° F. The cooled and partially condensed gas flowing in conduit 7 is passed to a phase separator 204. From separator 204 a condensed liquid stream containing heavy hydrocarbons is withdrawn through conduit 8 and an uncondensed vapor stream is withdrawn through conduit 10. The condensed heavy hydrocarbon stream flowing in conduit 8 is elevated in pressure to the product gas pipeline pressure in conduit 9 and combined with the predominantly methane stream exiting the nitrogen rejection system in conduit 38, as will be explained more fully hereinafter. The uncondensed vapor stream in conduit 10, essentially free of heavy hydrocarbons, is divided so that a portion of the vapor flowing in conduit 10 passes through conduit 13 and is cooled by heat exchange with cooled exiting gas streams in chiller 206.

The temperature of the cooled and partially condensed gas exiting chiller 206 in conduit 14 is reduced as the nitrogen content of the feed gas increases as will be illustrated in the examples hereinafter. The cooled and partially condensed gas flowing in conduit 14 is passed to a phase separator 208. From separator 208 a condensed liquid stream is withdrawn through conduit 15. The liquid flowing in conduit 15 is expanded in expansion valve 209 and passed to the bottom of the high pressure (HP) fractionator 210 via conduit 16. An uncondensed vapor stream is withdrawn from separator 208 through conduit 18. The uncondensed vapor stream flowing in conduit 18 is cooled sufficiently in chiller 212 by heat exchange with cooled exiting gas streams so as to at least partially condense the vapor entering chiller 212 in conduit 18. The cooled and partially condensed gas stream exiting chiller 212 in conduit 19 is further cooled in passing through an expansion device such as expansion valve 213 and into conduit 20 from where the partially condensed gas is fed to a tray at or near the middle of the HP fractionator 210.

Chiller 206 and separator 208 are bypassed by the combination of conduits 11 and 12 and expansion valve 214. The uncondensed vapor flowing in conduit 11 is cooled and partially condensed in passing through valve 214, or other similar expansion device, into conduit 12. The predominantly vapor stream flowing in conduit 12 is combined with the predominantly liquid stream flowing in conduit 16 and the mixture enters the bottom of the HP fractionator via conduit 17. The predominantly vapor stream is provided via conduit 12 to the bottom of HP fractionator 210 so as to provide stripping vapors to increase the amount of nitrogen rejected by the fractionator 210.

The HP fractionator 210 is operated at conditions sufficient to produce an overhead fraction which is a nitrogen-enriched gas stream withdrawn through conduit 21, and a bottoms fraction which is a methane-enriched liquid stream withdrawn through conduit 50. The nitrogen enriched uncondensed vapor stream flowing in conduit 21 is cooled in chiller 216 by heat exchange with a reboiler stream for the low pressure (LP) fractionator 218. The thus cooled and partially condensed gas is withdrawn from chiller 216 via conduit 22 and passed to chiller 220 for further cooling and condensing by heat exchange with cooled exiting streams in chiller 220. The nitrogen-enriched vapor withdrawn from HP fractionator 210, which is now predominantly liquid after passing through chillers 216 and 220, is withdrawn from chiller 220 via conduit 23 and passed to phase separator 222. A liquid stream is withdrawn from separator 222 through the combination of conduits 24 and 25 and returned to HP fractionator 210 as a upper external liquid reflux via conduit 25.

A vapor stream is withdrawn from separator 222 via conduit 26 and passed to chiller 224 where the vapor stream entering the chiller 224 via conduit 26 is cooled and partially condensed before being withdrawn from chiller 224 via conduit 27. The thus cooled and partially condensed vapors are fed via conduit 27 to phase separator 226. A liquid stream is withdrawn from separator 226 via conduit 28 and passed through valve 228 into conduit 29 where the pressure is reduced so as to effect flashing of the liquid which is then fed to a tray at or near the middle of the LP fractionator 218 via conduit 29. An uncondensed vapor stream is withdrawn from separator 226 via conduit 30 and is passed to an expander, or similar expansion means, 230. The thus expanded and partially condensed vapors are withdrawn from expander 230 via conduit 31 and provided as the main feedstream for LP fractionator 218. This main feedstream is supplied to an upper portion of LP fractionator 218.

An overhead high purity nitrogen product stream and a bottoms high purity methane product stream are withdrawn from LP fraction-ator 218 at a pressure level of about 30 psia via conduits 42 and 32 respectively. The high purity methane stream flowing in conduit 32 is elevated in pressure and provided to conduit 33. A methane enriched bottoms stream still containing a significant amount of nitrogen is withdrawn from the HP fractionator 210 via conduit 50 at a pressure level of about 450 psia. A portion of the methane enriched stream flowing in conduit 50 is supplied to conduit 53 at a pressure level of about 450 psia and the remaining portion of the stream flowing in conduit 50 is elevated in pressure and supplied to conduit 52 at a pressure level of about 720 psia.

In a preferred embodiment of the invention, the cooled exiting streams flowing in conduits 42, 33, 52, and 53 are utilized to provide much of the refrigeration necessary in the separation steps by countercurrent flow heat exchange with incoming or internal streams in the nitrogen rejection system. Additional cooling for the feedstreams in chillers 200, 206, and 212 is provided by depressurizing the portion of the HP fractionator 210 bottoms stream flowing in conduit 53, exchanging heat with the feed streams, and then recompressing the stream to product gas pipeline pressure.

The high purity nitrogen stream flowing from LP fractionator 218 in conduit 42 is heated in chiller 224 by countercurrent flow heat exchange with the nitrogen stream from separator 222 which is flowing in conduit 26. The high purity nitrogen stream exits chiller 224 in conduit 43 and is then further heated in chillers 212, 206, and 200. As illustrated in FIG. 1 the high purity nitrogen stream exits chillers 212, 206, and 200 in conduits 44, 46, and 48 respectively. Conduits 45, 47, and 49 which respectively extend conducts 44, 46, and 48 are illustrated in FIG. 1 to correspond to the data presented hereinafter in Tables 1 and 2 giving the conditions of a composition the fluid flowing at these points in the process.

The high purity methane stream from LP fractionator 218 flowing in conduit 34 is heated by countercurrent flow heat exchange with an internal stream in chiller 212. After exiting chiller 212 via conduit 35 the high purity methane stream is combined with the portion of the methane enriched stream from HP fractionator 210 which is flowing in conduit 52. The thus combined stream flowing in conduit 36 is further heated and partially vaporized in chiller 206. After exiting chiller 206 in conduit 37 the combined stream is divided. A portion of the stream flowing in conduit 37 is supplied to conduit 38 and combined with the heavy hydrocarbon liquid stream flowing in conduit 9. The thus combined stream enters chiller 200 via conduit 39 where it is further heated and essentially vaporized in chiller 200, before exiting chiller 200 in conduit 40.

The remaining portion of the stream flowing in conduit 37 is supplied to conduit 71 and is depressurized across a valve or similar expansion device 232 and enters conduit 72 and chiller 200 where it is heated and vaporized by countercurrent flow heat exchange with the feed stream flowing in conduit 5. On exiting chiller 200 as a vapor in conduit 73, this stream is pressurized and cooled in a compressor 260 and is combined with the product gas stream 41 via conduit 69.

The portion of the methane enriched bottoms stream withdrawn from HP fractionator 210 in conduit 53 is divided to flow in conduits 54, 55, and 56. Streams 54 and 53 are depressurized across valves 234 and 236 respectively and the stream flowing in conduit 54 is then heated in chiller 220 by counter-current flow heat exchange with an internal stream and is then recombined in conduit 56. The stream flowing in conduit 56 is then heated and vaporized in the series of chillers 212, 206, and 200 via conduits 56, 58, and 60, respectively, and is then elevated in pressure in compressor 260 and combined with the high purity methane stream flowing in conduit 69 to provide a suitable pipeline gas.

The following examples are presented in further illustration of the invention and are not to be considered as unduly limiting the scope of this invention.

EXAMPLE 1

This example illustrates nitrogen rejection from a gaseous stream containing about 40 mole % nitrogen according to the improved process of this invention. The feedstream 3 is a gaseous stream having a com-position which might be found in a gas stream actually produced in a reservoir flood during a relatively early stage of an EOR project.

Table I, below, shows the composition, temperature, pressure, vapor fraction and mass flow rate which were calculated from heat and material balance considerations. The numbers in the left hand column of Table II refer to the conduits (or equivalently streams) designated by the corresponding reference numeral in FIG. 1.

EXAMPLE 2

This example illustrates nitrogen rejection from a gaseous stream containing about 70 mole % nitrogen according to the improved process of this invention. The feed stream is a gaseous stream having a composition which might be found in a gas stream actually produced in a reservoir flood during a relatively late stage of an EOR project.

Table II below shows the composition, temperature, pressure, vapor fraction, and mass flow rate which were calculated from heat and material balance considerations. The numbers in the left hand column of Table II refer to the conduits (or equivalently streams) designated by the corresponding reference numeral in FIG. 1.

TABLE I

| Conduit/ | Mole Fraction | | | | | | °F. | psia | lb/day | Vapor |
|---|---|---|---|---|---|---|---|---|---|---|
| Stream | $N_2$ | $C_1$ | $C_2$ | $C_3$ | i-$C_4$ | n-$C_4$ | Temp | Press | Flow | Fraction |
| 3 | 0.391 | 0.526 | 0.050 | 0.020 | 0.006 | 0.002 | 75 | 725 | .616 E + 08 | 1.0 |
| 5 | 0.391 | 0.526 | 0.050 | 0.020 | 0.006 | 0.002 | 75 | 725 | .616 E + 08 | 1.0 |
| 6 | 0.391 | 0.526 | 0.050 | 0.020 | 0.006 | 0.002 | −60 | 725 | .616 E + 08 | .961 |
| 7 | 0.391 | 0.526 | 0.050 | 0.020 | 0.006 | 0.002 | −61 | 700 | .616 E + 08 | .961 |
| 8 | 0.048 | 0.267 | 0.199 | 0.245 | 0.116 | 0.051 | −61 | 700 | .400 E + 07 | 0 |
| 9 | 0.048 | 0.267 | 0.199 | 0.245 | 0.116 | 0.051 | −61 | 710 | .400 E + 07 | 0 |
| 10 | 0.405 | 0.537 | 0.044 | 0.011 | 0.002 | 0.000 | −61 | 700 | .576 E + 08 | 1.0 |
| 11 | 0.405 | 0.537 | 0.044 | 0.011 | 0.002 | 0.000 | −61 | 700 | .150 E + 07 | 1.0 |
| 12 | 0.405 | 0.537 | 0.044 | 0.011 | 0.002 | 0.000 | −79 | 450 | .150 E + 07 | .995 |
| 13 | 0.405 | 0.537 | 0.044 | 0.011 | 0.002 | 0.000 | −61 | 700 | .561 E + 08 | 1.0 |
| 14 | 0.405 | 0.537 | 0.044 | 0.011 | 0.002 | 0.000 | −159 | 700 | .561 E + 08 | .480 |
| 15 | 0.268 | 0.626 | 0.080 | 0.022 | 0.003 | 0.001 | −159 | 690 | .270 E + 08 | 0 |
| 16 | 0.268 | 0.626 | 0.080 | 0.022 | 0.003 | 0.001 | −176 | 450 | .270 E + 08 | .220 |
| 17 | 0.274 | 0.621 | 0.078 | 0.021 | 0.003 | 0.001 | −173 | 450 | .286 E + 08 | .279 |
| 18 | 0.543 | 0.448 | 0.008 | 0.001 | 0.000 | 0.000 | −159 | 690 | .290 E + 08 | 1.0 |
| 19 | 0.543 | 0.448 | 0.008 | 0.001 | 0.000 | 0.000 | −183 | 690 | .290 E + 08 | 0 |
| 20 | 0.543 | 0.448 | 0.008 | 0.001 | 0.000 | 0.000 | −201 | 450 | .290 E + 08 | .389 |
| 21 | 0.900 | 0.100 | 0.000 | 0.000 | 0.000 | 0.000 | −224 | 450 | .378 E + 08 | 1.0 |
| 22 | 0.900 | 0.100 | 0.000 | 0.000 | 0.000 | 0.000 | −227 | 445 | .378 E + 08 | .730 |
| 23 | 0.900 | 0.100 | 0.000 | 0.000 | 0.000 | 0.000 | −230 | 445 | .378 E + 08 | .295 |
| 24 | 0.873 | 0.127 | 0.000 | 0.000 | 0.000 | 0.000 | −230 | 440 | .221 E + 08 | 0 |
| 25 | 0.873 | 0.127 | 0.000 | 0.000 | 0.000 | 0.000 | −230 | 450 | .221 E + 08 | 0 |
| 26 | 0.939 | 0.061 | 0.000 | 0.000 | 0.000 | 0.000 | −230 | 440 | .157 E + 08 | 1.0 |
| 27 | 0.939 | 0.061 | 0.000 | 0.000 | 0.000 | 0.000 | −232 | 435 | .157 E + 08 | .729 |
| 28 | 0.903 | 0.097 | 0.000 | 0.000 | 0.000 | 0.000 | −232 | 435 | .418 E + 07 | 0 |
| 29 | 0.903 | 0.097 | 0.000 | 0.000 | 0.000 | 0.000 | −305 | 30 | .418 E + 07 | .492 |
| 30 | 0.953 | 0.047 | 0.000 | 0.000 | 0.000 | 0.000 | −232 | 435 | .115 E + 08 | 1.0 |
| 31 | 0.953 | 0.047 | 0.000 | 0.000 | 0.000 | 0.000 | −306 | 30 | .115 E + 08 | .687 |
| 32 | 0.000 | 1.000 | 0.000 | 0.000 | 0.000 | 0.000 | −242 | 30 | .474 E + 06 | 0 |
| 33 | 0.000 | 1.000 | 0.000 | 0.000 | 0.000 | 0.000 | −241 | 730 | .474 E + 06 | 0 |
| 34 | 0.000 | 1.000 | 0.000 | 0.000 | 0.000 | 0.000 | −191 | 730 | .474 E + 06 | 0 |
| 35 | 0.000 | 1.000 | 0.000 | 0.000 | 0.000 | 0.000 | −191 | 720 | .474 E + 06 | 0 |
| 36 | 0.250 | 0.678 | 0.055 | 0.014 | 0.002 | 0.001 | −184 | 720 | .266 E + 08 | 0 |
| 37 | 0.250 | 0.678 | 0.055 | 0.014 | 0.002 | 0.001 | −74 | 720 | .266 E + 08 | .978 |
| 38 | 0.250 | 0.678 | 0.055 | 0.014 | 0.002 | 0.001 | −74 | 720 | .266 E + 08 | .978 |
| 39 | 0.235 | 0.647 | 0.066 | 0.031 | 0.011 | 0.004 | −70 | 710 | .306 E + 08 | .882 |
| 40 | 0.235 | 0.647 | 0.066 | 0.031 | 0.011 | 0.004 | 67 | 710 | .306 E + 08 | 1.0 |
| 41 | 0.235 | 0.647 | 0.066 | 0.031 | 0.011 | 0.004 | 67 | 700 | .306 E + 08 | 1.0 |
| 42 | 0.990 | 0.010 | 0.000 | 0.000 | 0.000 | 0.000 | −305 | 30 | .152 E + 08 | 1.0 |
| 43 | 0.990 | 0.010 | 0.000 | 0.000 | 0.000 | 0.000 | −235 | 28 | .152 E + 08 | 1.0 |
| 44 | 0.990 | 0.010 | 0.000 | 0.000 | 0.000 | 0.000 | −191 | 28 | .152 E + 08 | 1.0 |
| 45 | 0.990 | 0.010 | 0.000 | 0.000 | 0.000 | 0.000 | −191 | 26 | .152 E + 08 | 1.0 |
| 46 | 0.990 | 0.010 | 0.000 | 0.000 | 0.000 | 0.000 | −74 | 26 | .152 E + 08 | 1.0 |
| 47 | 0.990 | 0.010 | 0.000 | 0.000 | 0.000 | 0.000 | −74 | 24 | .152 E + 08 | 1.0 |
| 48 | 0.990 | 0.010 | 0.000 | 0.000 | 0.000 | 0.000 | 67 | 24 | .152 E + 08 | 1.0 |
| 49 | 0.990 | 0.010 | 0.000 | 0.000 | 0.000 | 0.000 | 67 | 22 | .152 E + 08 | 1.0 |
| 50 | 0.256 | 0.670 | 0.057 | 0.014 | 0.002 | 0.001 | −185 | 450 | .419 E + 08 | 0 |
| 51 | 0.256 | 0.670 | 0.057 | 0.014 | 0.002 | 0.001 | −185 | 450 | .261 E + 08 | 0 |
| 52 | 0.256 | 0.670 | 0.057 | 0.014 | 0.002 | 0.001 | −184 | 720 | .261 E + 08 | 0 |
| 53 | 0.256 | 0.670 | 0.057 | 0.014 | 0.002 | 0.001 | −185 | 450 | .158 E + 08 | 0 |
| 54 | 0.256 | 0.670 | 0.057 | 0.014 | 0.002 | 0.001 | −253 | 38 | .158 E + 08 | .398 |
| 55 | 0.256 | 0.670 | 0.057 | 0.014 | 0.002 | 0.001 | −244 | 38 | .158 E + 08 | .602 |
| 56 | 0.256 | 0.670 | 0.057 | 0.014 | 0.002 | 0.001 | −246 | 36 | .158 E + 08 | .605 |
| 57 | 0.256 | 0.670 | 0.057 | 0.014 | 0.002 | 0.001 | −191 | 36 | .158 E + 08 | .939 |
| 58 | 0.256 | 0.670 | 0.057 | 0.014 | 0.002 | 0.001 | −192 | 34 | .158 E + 08 | .940 |
| 59 | 0.256 | 0.670 | 0.057 | 0.014 | 0.002 | 0.001 | −74 | 34 | .158 E + 08 | 1.0 |
| 60 | 0.256 | 0.670 | 0.057 | 0.014 | 0.002 | 0.001 | −74 | 32 | .158 E + 08 | 1.0 |
| 61 | 0.256 | 0.670 | 0.057 | 0.014 | 0.002 | 0.001 | 67 | 32 | .158 E + 08 | 1.0 |
| 62 | 0.256 | 0.670 | 0.057 | 0.014 | 0.002 | 0.001 | 67 | 30 | .158 E + 08 | 1.0 |
| 69 | 0.256 | 0.670 | 0.057 | 0.014 | 0.002 | 0.001 | 125 | 700 | .158 E + 08 | 1.0 |
| 70 | 0.242 | 0.655 | 0.063 | 0.025 | 0.008 | 0.003 | 86 | 700 | .464 E + 08 | 1.0 |
| 71 | 0.250 | 0.678 | 0.055 | 0.014 | 0.002 | 0.001 | −74 | 720 | 26600 | .978 |
| 72 | 0.250 | 0.678 | 0.055 | 0.014 | 0.002 | 0.001 | −137 | 100 | 26600 | .973 |
| 73 | 0.250 | 0.678 | 0.055 | 0.014 | 0.002 | 0.001 | 67 | 100 | 26600 | 1.0 |

TABLE II

| Conduit/ | Mole Fraction | | | | | | °F. | psia | lb/day | Vapor |
|---|---|---|---|---|---|---|---|---|---|---|
| Stream | $N_2$ | $C_1$ | $C_2$ | $C_3$ | i-$C_4$ | n-$C_4$ | Temp | Press | Flow | Fraction |
| 3 | 0.681 | 0.276 | 0.026 | 0.011 | 0.003 | 0.001 | 80 | 725 | .325 E + 08 | 1.0 |
| 5 | 0.681 | 0.276 | 0.026 | 0.011 | 0.003 | 0.001 | 76 | 725 | .325 E + 08 | 1.0 |
| 6 | 0.681 | 0.276 | 0.026 | 0.011 | 0.003 | 0.001 | −60 | 725 | .325 E + 08 | .992 |
| 7 | 0.681 | 0.276 | 0.026 | 0.011 | 0.003 | 0.001 | −61 | 700 | .325 E + 08 | .992 |

TABLE II-continued

| Conduit/ | Mole Fraction | | | | | | °F. | psia | lb/day | Vapor |
|---|---|---|---|---|---|---|---|---|---|---|
| Stream | $N_2$ | $C_1$ | $C_2$ | $C_3$ | i-$C_4$ | n-$C_4$ | Temp | Press | Flow | Fraction |
| 8 | 0.064 | 0.127 | 0.127 | 0.242 | 0.172 | 0.090 | −61 | 700 | .468 E + 06 | 0 |
| 9 | 0.064 | 0.127 | 0.127 | 0.242 | 0.172 | 0.090 | −61 | 710 | .468 E + 06 | 0 |
| 10 | 0.686 | 0.277 | 0.026 | 0.009 | 0.002 | 0.001 | −61 | 700 | .320 E + 08 | 1.0 |
| 11 | 0.686 | 0.277 | 0.026 | 0.009 | 0.002 | 0.001 | −61 | 700 | .512 E + 07 | 1.0 |
| 12 | 0.686 | 0.277 | 0.026 | 0.009 | 0.002 | 0.001 | −75 | 450 | .511 E + 07 | .998 |
| 13 | 0.686 | 0.277 | 0.026 | 0.009 | 0.002 | 0.001 | −61 | 700 | .269 E + 08 | 1.0 |
| 14 | 0.686 | 0.277 | 0.026 | 0.009 | 0.002 | 0.001 | −170 | 700 | .269 E + 08 | .926 |
| 15 | 0.195 | 0.408 | 0.245 | 0.115 | 0.026 | 0.008 | −170 | 690 | .209 E + 07 | 0 |
| 16 | 0.195 | 0.408 | 0.245 | 0.115 | 0.026 | 0.008 | −178 | 450 | .209 E + 07 | .114 |
| 17 | 0.550 | 0.313 | 0.086 | 0.038 | 0.009 | 0.003 | −128 | 450 | .721 E + 07 | .841 |
| 18 | 0.724 | 0.267 | 0.008 | 0.000 | 0.000 | 0.000 | −170 | 690 | .248 E + 08 | 1.0 |
| 19 | 0.724 | 0.267 | 0.008 | 0.000 | 0.000 | 0.000 | −183 | 690 | .248 E + 08 | .991 |
| 20 | 0.724 | 0.267 | 0.008 | 0.000 | 0.000 | 0.000 | −202 | 450 | .248 E + 08 | .878 |
| 21 | 0.900 | 0.100 | 0.000 | 0.000 | 0.000 | 0.000 | −224 | 450 | .476 E + 08 | 1.0 |
| 22 | 0.900 | 0.100 | 0.000 | 0.000 | 0.000 | 0.000 | −227 | 445 | .476 E + 08 | .703 |
| 23 | 0.900 | 0.100 | 0.000 | 0.000 | 0.000 | 0.000 | −230 | 445 | .476 E + 08 | .344 |
| 24 | 0.869 | 0.131 | 0.000 | 0.000 | 0.000 | 0.000 | −230 | 440 | .259 E + 08 | 0 |
| 25 | 0.869 | 0.131 | 0.000 | 0.000 | 0.000 | 0.000 | −230 | 450 | .259 E + 08 | 0 |
| 26 | 0.938 | 0.062 | 0.000 | 0.000 | 0.000 | 0.000 | −230 | 440 | .217 E + 08 | 1.0 |
| 27 | 0.938 | 0.062 | 0.000 | 0.000 | 0.000 | 0.000 | −232 | 435 | .217 E + 08 | .731 |
| 28 | 0.900 | 0.100 | 0.000 | 0.000 | 0.000 | 0.000 | −232 | 435 | .574 E + 07 | 0 |
| 29 | 0.900 | 0.100 | 0.000 | 0.000 | 0.000 | 0.000 | −305 | 30 | .574 E + 07 | .492 |
| 30 | 0.951 | 0.049 | 0.000 | 0.000 | 0.000 | 0.000 | −232 | 435 | .160 E + 08 | 1.0 |
| 31 | 0.951 | 0.049 | 0.000 | 0.000 | 0.000 | 0.000 | −306 | 30 | .160 E + 08 | .689 |
| 32 | 0.000 | 1.000 | 0.000 | 0.000 | 0.000 | 0.000 | −242 | 30 | .677 E + 06 | 0 |
| 33 | 0.000 | 1.000 | 0.000 | 0.000 | 0.000 | 0.000 | −241 | 730 | .677 E + 06 | 0 |
| 34 | 0.000 | 1.000 | 0.000 | 0.000 | 0.000 | 0.000 | −211 | 730 | .677 E + 06 | 0 |
| 35 | 0.000 | 1.000 | 0.000 | 0.000 | 0.000 | 0.000 | −211 | 720 | .677 E + 06 | 0 |
| 36 | 0.189 | 0.742 | 0.047 | 0.016 | 0.003 | 0.001 | −195 | 720 | .274 E + 07 | 0 |
| 37 | 0.189 | 0.742 | 0.047 | 0.016 | 0.003 | 0.001 | −97 | 720 | .274 E + 07 | .906 |
| 38 | 0.189 | 0.742 | 0.047 | 0.016 | 0.003 | 0.001 | −97 | 720 | .274 E + 07 | .906 |
| 39 | 0.181 | 0.701 | 0.052 | 0.031 | 0.015 | 0.007 | −89 | 710 | .321 E + 07 | .806 |
| 40 | 0.181 | 0.701 | 0.052 | 0.031 | 0.015 | 0.007 | 54 | 710 | .321 E + 07 | .992 |
| 41 | 0.181 | 0.701 | 0.052 | 0.031 | 0.015 | 0.007 | 53 | 700 | .321 E + 07 | .992 |
| 42 | 0.990 | 0.010 | 0.000 | 0.000 | 0.000 | 0.000 | −305 | 30 | .210 E + 08 | 1.0 |
| 43 | 0.990 | 0.010 | 0.000 | 0.000 | 0.000 | 0.000 | −235 | 28 | .210 E + 08 | 1.0 |
| 44 | 0.990 | 0.010 | 0.000 | 0.000 | 0.000 | 0.000 | −210 | 28 | .210 E + 08 | 1.0 |
| 45 | 0.990 | 0.010 | 0.000 | 0.000 | 0.000 | 0.000 | −211 | 26 | .210 E + 08 | 1.0 |
| 46 | 0.990 | 0.010 | 0.000 | 0.000 | 0.000 | 0.000 | −96 | 26 | .210 E + 08 | 1.0 |
| 47 | 0.990 | 0.010 | 0.000 | 0.000 | 0.000 | 0.000 | −97 | 24 | .210 E + 08 | 1.0 |
| 48 | 0.990 | 0.010 | 0.000 | 0.000 | 0.000 | 0.000 | 54 | 24 | .210 E + 08 | 1.0 |
| 49 | 0.990 | 0.010 | 0.000 | 0.000 | 0.000 | 0.000 | 53 | 22 | .210 E + 08 | 1.0 |
| 50 | 0.271 | 0.631 | 0.068 | 0.023 | 0.005 | 0.002 | −190 | 450 | .103 E + 07 | 0 |
| 51 | 0.271 | 0.631 | 0.068 | 0.023 | 0.005 | 0.002 | −190 | 450 | .206 E + 07 | 0 |
| 52 | 0.271 | 0.631 | 0.068 | 0.023 | 0.005 | 0.002 | −189 | 720 | .206 E + 07 | 0 |
| 53 | 0.271 | 0.631 | 0.068 | 0.023 | 0.005 | 0.002 | −190 | 450 | .822 E + 07 | 0 |
| 54 | 0.271 | 0.631 | 0.068 | 0.023 | 0.005 | 0.002 | −255 | 38 | .822 E + 07 | .386 |
| 55 | 0.271 | 0.631 | 0.068 | 0.023 | 0.005 | 0.002 | −232 | 38 | .822 E + 07 | .799 |
| 56 | 0.271 | 0.631 | 0.068 | 0.023 | 0.005 | 0.002 | −234 | 36 | .822 E + 07 | .801 |
| 57 | 0.271 | 0.631 | 0.068 | 0.023 | 0.005 | 0.002 | −211 | 36 | .822 E + 07 | .881 |
| 58 | 0.271 | 0.631 | 0.068 | 0.023 | 0.005 | 0.002 | −212 | 34 | .822 E + 07 | .882 |
| 59 | 0.271 | 0.631 | 0.068 | 0.023 | 0.005 | 0.002 | −96 | 34 | .822 E + 07 | 1.0 |
| 60 | 0.271 | 0.631 | 0.068 | 0.023 | 0.005 | 0.002 | −97 | 32 | .822 E + 07 | 1.0 |
| 61 | 0.271 | 0.631 | 0.068 | 0.023 | 0.005 | 0.002 | 54 | 32 | .822 E + 07 | 1.0 |
| 62 | 0.271 | 0.631 | 0.068 | 0.023 | 0.005 | 0.002 | 53 | 30 | .822 E + 07 | 1.0 |
| 69 | 0.271 | 0.631 | 0.068 | 0.023 | 0.005 | 0.002 | 125 | 700 | .822 E + 08 | 1.0 |
| 70 | 0.246 | 0.650 | 0.063 | 0.025 | 0.008 | 0.003 | 102 | 700 | .114 E + 08 | 1.0 |
| 71 | 0.189 | 0.742 | 0.047 | 0.016 | 0.003 | 0.001 | −97 | 720 | 2740. | .906 |
| 72 | 0.189 | 0.742 | 0.047 | 0.016 | 0.003 | 0.001 | −170 | 100 | 2740. | .927 |
| 73 | 0.189 | 0.742 | 0.047 | 0.016 | 0.003 | 0.001 | 54 | 100 | 2470. | 1.0 |

The results indicated in Tables I and II show that the process of this invention maintains sufficient separation for feed streams widely varying in nitrogen content by maintaining the indicated process conditions, and that the inventive process will allow the use of nitrogen rejection units for providing sufficiently pure nitrogen for reinjecting in an EOR project.

It is to be understood that reasonable variations and modifications for various usages and conditions are possible by those skilled in the art, and such modifications and variations are within the scope of the described invention and the appended claims.

That which is claimed is:

1. A process for separating nitrogen from methane in a distillation system employing a high pressure (HP) fractionator and a low pressure (LP) fractionator, said process comprising the steps of:

(a) sufficiently cooling at least a portion of feedstream, essentially free of heavy hydrocarbons, comprising a gaseous nitrogen-methane mixture at a pressure of at least 400 psia so as to provide an at least partially condensed feedstream;

(b) separating said at least partially condensed feed stream in a first phase separator and withdrawing from said first phase separator a first stream comprising gaseous nitrogen-methane and a second stream comprising liquid nitrogen-methane, wherein said first stream is enriched in nitrogen and said second stream is enriched in methane;

(c) sufficiently cooling said first stream so as to provide an at least partially condensed first stream and introducing said at least partially condensed first stream into a middle portion of said HP fractionator;

(d) sufficiently expanding said second stream so as to provide an at least partially vaporized second stream and introducing said at least partially vaporized second stream into a lower portion of said HP fractionator, wherein said at least partially condensed first stream and said at least partially vaporized second stream are simultaneously fractionated in said HP fractionator at conditions sufficient to produce a third stream predominately comprising gaseous nitrogen and a fourth stream predominately comprising liquid methane;

(e) sufficiently cooling said third stream so as to provide a partially condensed third stream;

(f) separating said partially condensed third stream in a second phase separator and withdrawing from said second phase separator a fifth stream predominately comprising liquid nitrogen and a sixth stream predominately comprising gaseous nitrogen;

(g) introducing said fifth stream into said HP fractionator as a liquid reflux;

(h) sufficiently cooling said sixth stream so as to provide an at least partially condensed sixth stream;

(i) separating said at least partially condensed sixth stream in a third phase separator and withdrawing a seventh stream predominately comprising liquid nitrogen and an eighth stream predominately comprising gaseous nitrogen from said third phase separator;

(j) introducing said seventh stream into a middle portion of said LP fractionator;

(k) expanding at least a portion of said eighth stream in an expander prior to introducing said eighth stream into an upper portion of said LP fractionator;

(l) recovering an overhead stream from said LP fractionator as a nitrogen product stream;

(m) withdrawing a bottom stream from said LP fractionator; and (n) combining said bottom stream with said fourth stream to form a hydrocarbon product gas stream.

2. A process in accordance with claim 1 additionally comprising the following steps:

bypassing a portion of said feedstream around said cooling step recited in paragraph (a) and said separating step recited in paragraph (b) thereby providing a bypass portion of said feedstream;

blending said bypass portion of said feedstream with said at least partially vaporized second stream prior to said step of introducing said at least partially vaporized second stream into said lower portion of said HP fractionator recited in paragraph (d).

3. A process in accordance with claim 1 wherein the nitrogen content of said feed stream increases over a period of time, said process additionally comprising the steps of:

reducing the temperature of said feedstream by increasing the amount of cooling provided by said step of cooling at least a portion of a feed stream recited in paragraph (a) as the nitrogen content of said feedstream increases.

4. A process in accordance with claim 3 wherein the nitrogen content of said feed stream varies from about 25 mole % to about 80 mole

5. A process in accordance with claim 4 wherein said step of cooling a feed stream recited in paragraph (a) comprises countercurrent flow heat exchange between said feed stream and both said nitrogen product stream and said hydrocarbon product gas stream.

6. A process in accordance with claim 2 additionally comprising the step of:

expanding said at least partially condensed first stream prior to introducing said at least partially condensed first stream into said middle portion of said HP fractionator in step (c).

7. A process for separating nitrogen from a miscible flood gas comprising nitrogen, methane, and heavy hydrocarbons in a distillation system employing a high pressure (HP) fractionator and. a low pressure (LP) fractionator, said process comprising the steps of:

(a) sufficiently cooling at least a portion of a feed stream comprising said miscible flood gas at a pressure of at least 400 psia so as to provide an at least partially condensed feed stream;

(b) recombining said feedstream so as to form an at least partially condensed feedstream and separating said at least partially condensed feedstream in a first phase separator and withdrawing from said first phase separator a first stream comprising a gaseous nitrogen-methane mixture and a second stream comprising heavy hydrocarbons;

(c) sufficiently cooling at least a portion of said first stream comprising a gaseous nitrogen-methane mixture so as to provide an at least partially condensed first stream;

(d) separating said at least partially condensed first stream in a second phase separator and withdrawing from said second phase separator a third stream comprising gaseous nitrogen-methane and a fourth stream comprising liquid nitrogen-methane, wherein said third stream is enriched in nitrogen and said fourth stream is enriched in methane;

(e) sufficiently cooling said third stream so as to provide an at least partially condensed third stream, and introducing said at least partially condensed third stream into a middle portion of said HP fractionator;

(f) sufficiently expanding said fourth stream so as to provide an at least partially vaporized fourth stream, and introducing said at least partially vaporized fourth stream into a lower portion of said HP fractionator wherein said at least partially condensed third stream and said at least partially vaporized fourth stream are simultaneously fractionated in said HP fractionator at conditions sufficient to produce a fifth stream predominately comprising gaseous nitrogen and a sixth stream predominately comprising liquid methane;

(g) sufficiently cooling said fifth stream so as to provide an at least partially condensed fifth stream;

(h) separating said at least partially condensed fifth stream in a third phase separator and withdrawing from said third phase separator a seventh stream predominately comprising liquid nitrogen and an eighth stream predominately comprising gaseous nitrogen;

(i) introducing said seventh stream into an upper portion of said HP fractionator as a liquid reflux;

(j) sufficiently cooling said eighth stream so as to provide an at least partially condensed eighth stream;

(k) separating said at least partially condensed eighth stream in a fourth phase separator and withdrawing from said fourth phase separator a ninth stream predominately comprising liquid nitrogen and a tenth stream predominately comprising gaseous nitrogen;

(l) introducing said ninth stream into a middle portion of said LP fractionator;

(m) expanding at least a portion of said tenth stream in an expander prior to introducing said tenth stream into the upper portion of said LP fractionator;

(n) withdrawing an overhead stream from said LP fractionator as a nitrogen product stream; and (o) forming a hydrocarbon product gas stream by combining a bottom stream withdrawn from said LP fractionator and said sixth stream and said second stream.

8. A process in accordance with claim 7 additionally comprising the following steps:

bypassing a portion of said first stream around said cooling step recited in paragraph (c) and said separating step recited in paragraph (d) thereby providing a bypassed portion of said first stream;

blending said bypassed portion of said first stream with said fourth stream prior to said step of introducing said at least partially vaporized fourth stream into a lower portion of said HP fractionator recited in paragraph (f).

9. A process in accordance with claim 7 wherein the nitrogen content of said feedstream increases over a period of time, said method additionally comprising the steps of:

reducing the temperature of said first stream by increasing the amount of cooling provided by said step of cooling at least a portion of said first stream recited in paragraph (c) as the nitrogen content of said feed stream increases.

10. A process in accordance with claim 9 wherein the nitrogen content of said feed stream varies from about 25 mole-% to about 80 mole-%.

11. A process in accordance with claim 10 wherein said step of cooling at least a portion of a first stream recited in paragraph (c) comprises countercurrent flow heat exchange between said first stream and said nitrogen product stream and said hydrocarbon product gas stream.

12. Apparatus for separating nitrogen and methane in a feedstream, essentially free of heavy hydrocarbons, and comprising a gaseous nitrogen-methane mixture at a pressure of at least 400 psia, said apparatus comprising:

first cooling means for cooling a feedstream;

means for introducing a first portion of said feedstream into said first cooling means wherein said first portion of said feedstream is sufficiently cooled so as to produce a partially condensed feedstream;

first liquid/vapor phase separator means;

means in fluid flow communications between said first cooling means and said first liquid/vapor phase separator means for introducing said partially condensed feedstream into said first liquid/vapor phase separator means wherein said partially condensed feedstream is separated in said first liquid/vapor phase separator means to produce a first stream comprising gaseous nitrogen-methane and a second stream comprising liquid nitrogen methane;

second cooling means for cooling a gaseous stream;

means in fluid flow communication between said first liquid/vapor phase separator means and said second cooling means for withdrawing said first stream comprising gaseous nitrogen-methane from said first liquid/vapor separator means and for introducing said first stream into said second cooling means wherein said first stream is sufficiently cooled so as to produce a partially condensed first stream;

first fractionator means;

means in fluid flow communication between said first fractionator means and said first liquid/vapor phase separator means for withdrawing from said first liquid/vapor phase separator means said second stream comprising liquid nitrogen methane and for combining said second stream with a second portion of said feedstream to produce a third stream and for introducing said third stream into a lower portion of said first fractionator means;

means in fluid flow communication between said second cooling means and a middle portion of said first fractionator means for withdrawing said partially condensed first stream from said second cooling means and for introducing said partially condensed first stream into said middle portion of said first fractionator means, wherein said partially condensed first stream and third stream are simultaneously fractionated in said first fractionator means, under conditions sufficient to produce a fourth stream predominating in gaseous nitrogen and a fifth steam predominating in liquid methane;

third cooling means;

means in fluid flow communication between said first fractionator means and said third cooling means for withdrawing said fourth stream from said first fractionator means and for introducing said fourth stream into said third cooling means wherein said fourth stream is cooled sufficiently to produce a partially condensed fourth stream;

second liquid/vapor phase separator means;

means in fluid flow communication between said third cooling means and said second liquid/vapor phase separator means for withdrawing said partially condensed fourth stream from said third cooling means and for introducing said partially condensed fourth stream into said second liquid/vapor phase separator means wherein said partially condensed fourth stream is separated to produce a gaseous sixth stream and a liquid seventh stream;

means in fluid flow communication between said second liquid/vapor phase separator means and said first fractionator means for withdrawing said liquid seventh stream from said second liquid/vapor phase separator means and for introducing said liquid seventh stream as a liquid reflux stream into said first fractionator means;

fourth cooling means for cooling a gaseous stream;

means in fluid flow communication between said second liquid/vapor phase separator means and said fourth cooling means for withdrawing said gaseous sixth stream from said second liquid/vapor separator means and introducing said gaseous sixth stream into said fourth cooling means wherein said gaseous sixth stream is sufficiently cooled so as to provide an at least partially condensed sixth stream;

third liquid/vapor phase separator means;

means in fluid flow communication between said fourth cooling means and said third liquid/vapor phase separator means for withdrawing said at least partially condensed sixth stream from said fourth cooling means and for introducing said at least partially condensed sixth stream into said third liquid/vapor phase separator means wherein said at least partially condensed sixth stream is separated to produce an eighth stream comprising gaseous nitrogen-methane and a ninth stream comprising liquid nitrogen-methane;

second fractionator means;

means in fluid flow communication between said third liquid/vapor phase separator means and said second fractionator means for withdrawing said eighth stream from said third liquid/vapor phase separator means, for expanding at least a portion of said eighth stream to produce an at least partially expanded eighth stream and for introducing said at least partially expanded eighth stream into an upper portion of said second fractionator means;

means in fluid flow communication between said third liquid/vapor phase separator means and said second fractionator means for withdrawing said ninth stream from said third liquid/vapor phase separator means and for introducing said ninth stream into a middle portion of said second fractionator means wherein said eighth stream and said ninth stream are simultaneously fractionated under conditions sufficient to produce an overhead stream comprising a high purity nitrogen product and a bottom stream comprising a high purity methane product.

13. Apparatus in accordance with claim 12 wherein:

said means in fluid flow communication between said second cooling means and said first fractionator means is characterized further to include a first expansion valve interposed therein for expanding said partially condensed first stream prior to introducing said partially condensed first stream into said middle portion of said first fractionator means; and said means in fluid flow communication between said third liquid/vapor phase separator means and said second fractionator means is characterized further to include a second expansion valve interposed therein for expanding said ninth stream prior to introducing said ninth stream into said middle portion of said second fractionator means.

* * * * *